US008896443B2

(12) United States Patent
Aaron

(10) Patent No.: US 8,896,443 B2
(45) **Date of Patent: *Nov. 25, 2014**

(54) DEVICES AND METHODS FOR DETECTING ENVIRONMENTAL CIRCUMSTANCES AND RESPONDING WITH DESIGNATED COMMUNICATION ACTIONS

(71) Applicant: AT&T Intellectual Property I, L.P., Atlanta, GA (US)

(72) Inventor: Jeffrey A. Aaron, Atlanta, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/943,161

(22) Filed: Jul. 16, 2013

(65) Prior Publication Data

US 2013/0300561 A1 Nov. 14, 2013

Related U.S. Application Data

(63) Continuation of application No. 13/463,180, filed on May 3, 2012, now Pat. No. 8,493,208, which is a continuation of application No. 11/668,803, filed on Jan. 30, 2007, now Pat. No. 8,199,003.

(51) Int. Cl.

| | |
|---|---|
| ***G08B 1/08*** | (2006.01) |
| ***G08B 21/04*** | (2006.01) |
| ***G08B 23/00*** | (2006.01) |

(52) U.S. Cl.

CPC ..... *G08B 23/00* (2013.01); *G08B 21/04* (2013.01)

USPC ..... 340/539.22; 340/539.11; 340/539.26; 340/539.28

(58) Field of Classification Search

USPC ..... 340/539.22

See application file for complete search history.

(56) References Cited

U.S. PATENT DOCUMENTS

| | | | |
|---|---|---|---|
| 4,853,628 | A | 8/1989 | Gouldsberry et al. |
| 5,505,057 | A | 4/1996 | Sato et al. |
| 5,812,932 | A | 9/1998 | Wiedeman et al. |
| 6,130,707 | A | 10/2000 | Koller et al. |
| 6,567,835 | B1 | 5/2003 | Blomgren et al. |
| 6,580,914 | B1 | 6/2003 | Smith |
| 6,587,835 | B1 | 7/2003 | Treyz et al. |

(Continued)

OTHER PUBLICATIONS

Aalto et al. "Bluetooth and WAP Push Based Location-Aware Mobile Advertising System", Jun. 2004.

(Continued)

*Primary Examiner* — Kerri McNally

(74) *Attorney, Agent, or Firm* — Gardner Groff Greenwald & Villanueva, P.C.

(57) ABSTRACT

Provided are a wireless communication device and a communication device control method that include a set of templates corresponding to a plurality of potential environmental circumstances. The templates may be stored in a database in the computer readable memory of the communication device. At predetermined intervals, a suite of environmental sensors integral to the communication device may periodically sample the user's environment. The user's environmental circumstances may be derived or inferred by an analysis module based on the output of the suite of environmental sensors and then may be compared to the templates to determine a matching template. An action script is then executed based at least partially on the matching template which may include the contacting of a responding party.

20 Claims, 3 Drawing Sheets

(56) References Cited

U.S. PATENT DOCUMENTS

| | | | | |
|---|---|---|---|---|
| 6,754,665 | B1 | 6/2004 | Futagami et al. | |
| 6,853,628 | B2 | 2/2005 | Chitrapu | |
| 6,892,217 | B1 | 5/2005 | Hanmann et al. | |
| 6,912,398 | B1 | 6/2005 | Domnitz | |
| 6,947,976 | B1 | 9/2005 | Devitt et al. | |
| 6,977,997 | B2 | 12/2005 | Shioda et al. | |
| 7,046,987 | B2 * | 5/2006 | Siegel et al. | 455/404.2 |
| 7,136,658 | B2 | 11/2006 | Cole et al. | |
| 7,136,688 | B2 | 11/2006 | Jung et al. | |
| 7,155,238 | B2 | 12/2006 | Katz | |
| 7,324,959 | B2 | 1/2008 | Malkin et al. | |
| 7,356,347 | B1 | 4/2008 | Kammar | |
| 7,554,441 | B2 * | 6/2009 | Viegers et al. | 340/539.22 |
| 7,599,795 | B1 | 10/2009 | Blumberg et al. | |
| 7,634,228 | B2 | 12/2009 | White et al. | |
| 7,646,297 | B2 | 1/2010 | Aaron | |
| 2002/0082931 | A1 | 6/2002 | Siegel et al. | |
| 2002/0095333 | A1 | 7/2002 | Jokinen et al. | |
| 2002/0101993 | A1 | 8/2002 | Eskin | |
| 2002/0147928 | A1 | 10/2002 | Mahajan et al. | |
| 2002/0178385 | A1 | 11/2002 | Dent et al. | |
| 2003/0006913 | A1 | 1/2003 | Joyce | |
| 2003/0008661 | A1 | 1/2003 | Joyce | |
| 2003/0050039 | A1 | 3/2003 | Baba et al. | |
| 2003/0198204 | A1 | 10/2003 | Taneja et al. | |
| 2004/0032503 | A1 | 2/2004 | Monden et al. | |
| 2004/0082351 | A1 | 4/2004 | Westman | |
| 2004/0092269 | A1 | 5/2004 | Kivinen | |
| 2004/0110515 | A1 | 6/2004 | Blumberg et al. | |
| 2004/0141606 | A1 | 7/2004 | Torvinen | |
| 2004/0209602 | A1 | 10/2004 | Joyce | |
| 2005/0073406 | A1 | 4/2005 | Easley et al. | |
| 2005/0075116 | A1 | 4/2005 | Laird et al. | |
| 2005/0113123 | A1 | 5/2005 | Torvinen | |
| 2005/0117516 | A1 | 6/2005 | Yang | |
| 2005/0149443 | A1 | 7/2005 | Torvinen | |
| 2005/0153729 | A1 | 7/2005 | Logan et al. | |
| 2005/0176420 | A1 | 8/2005 | Graves et al. | |
| 2005/0181824 | A1 | 8/2005 | Lloyd | |
| 2005/0215238 | A1 | 9/2005 | Macaluso | |
| 2005/0221876 | A1 | 10/2005 | Van Bosch et al. | |
| 2005/0248456 | A1 * | 11/2005 | Britton et al. | 340/539.29 |
| 2005/0266870 | A1 | 12/2005 | Benco et al. | |
| 2005/0288038 | A1 | 12/2005 | Kim | |
| 2006/0009240 | A1 | 1/2006 | Katz | |
| 2006/0015404 | A1 | 1/2006 | Tran | |
| 2006/0033625 | A1 | 2/2006 | Johnson et al. | |
| 2006/0047573 | A1 | 3/2006 | Mitchell et al. | |
| 2006/0089158 | A1 | 4/2006 | Lai et al. | |
| 2006/0095540 | A1 | 5/2006 | Anderson et al. | |
| 2006/0178932 | A1 | 8/2006 | Lang | |
| 2006/0194595 | A1 | 8/2006 | Myllynen et al. | |
| 2006/0224863 | A1 | 10/2006 | Lovett et al. | |
| 2006/0253282 | A1 * | 11/2006 | Schmidt et al. | 704/233 |
| 2006/0253453 | A1 | 11/2006 | Chmaytelli et al. | |
| 2007/0004393 | A1 | 1/2007 | Forsberg et al. | |
| 2007/0037561 | A1 | 2/2007 | Bowen et al. | |
| 2007/0037605 | A1 | 2/2007 | Logan | |
| 2007/0054687 | A1 | 3/2007 | Akita et al. | |
| 2007/0136796 | A1 | 6/2007 | Sanchez et al. | |
| 2007/0182544 | A1 | 8/2007 | Benson et al. | |
| 2007/0182818 | A1 | 8/2007 | Buehler | |
| 2007/0232342 | A1 | 10/2007 | Larocca | |
| 2007/0287379 | A1 | 12/2007 | Matsuura et al. | |
| 2008/0004951 | A1 | 1/2008 | Huang et al. | |
| 2008/0032677 | A1 | 2/2008 | Catovic et al. | |
| 2008/0045236 | A1 | 2/2008 | Nahon et al. | |
| 2008/0052169 | A1 | 2/2008 | O'Shea et al. | |
| 2008/0114778 | A1 | 5/2008 | Siegel | |
| 2008/0146205 | A1 | 6/2008 | Aaron | |
| 2008/0169921 | A1 * | 7/2008 | Peeters | 340/539.11 |
| 2008/0182563 | A1 | 7/2008 | Wugofski et al. | |
| 2008/0182586 | A1 | 7/2008 | Aaron | |
| 2008/0215415 | A1 | 9/2008 | Willms | |
| 2008/0268895 | A1 | 10/2008 | Foxenland | |
| 2009/0176524 | A1 | 7/2009 | David | |
| 2009/0292920 | A1 | 11/2009 | Willey | |

OTHER PUBLICATIONS

Huang et al. "A Self-Adaptive Zone Routing Protocol for Bluetooth Scatternets", Computer Communications; v28:1:37-50 (Jan. 2005).

Palo Wireless "K1-Generic Access Profile", http://www.palowireless.com/infotooth/tutorial/k1_gap.asp (2004).

Leopold et al. "Bluetooth and Sensor Networks: A Reality Check"; SenSys '03 (Nov. 2003).

Dodgeball.com bring your phone to life, http://www.dodgeball.com, copyright 2006.

Helio GPS-powered Buddy Beacon, http://www.helio.com, Dec. 2006.

OnStar Technology, http://www.onstar.com/US_english/jsp/explore/onstar_basics/tethnology.jsp, 2006.

GSP Locator Phone, http://www.wherify.com/wherifone/kids.html?page-kids, copyright 2006.

* cited by examiner

DEVICES AND METHODS FOR DETECTING ENVIRONMENTAL CIRCUMSTANCES AND RESPONDING WITH DESIGNATED COMMUNICATION ACTIONS

TECHNICAL FIELD

The subject matter described herein relates to systems and methods enabling the self actuation of a wireless communication device allowing it to adjust itself to the user's environmental circumstances.

BACKGROUND

The World is a dangerous place both inside and outside the home. The lack of a timely response by emergency assistance may mean the difference between life and death. In some instances an appeal from the victim is not possible such as when a victim is rendered unconscious or is physically incapacitated. Thus, there is a continuing need to increase the personal safety of individuals and the populace in general.

Wireless communication devices are popular and ubiquitous devices amongst the general populace. The cost of wireless communication devices has plummeted and functionality has improved exponentially. Most adults and a growing number of children routinely carry a cell phone or other wireless communication device on their person. While energized, wireless communication devices are continuously vigilant, scanning a frequency for an indication of an incoming call. The omnipresence, vigilance and computing power of a wireless communication device a can be leveraged to increase the personal safety of the wireless communication device user and others.

SUMMARY

It should be appreciated that this Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments of a communication device consistent with this disclosure may contain a set or a suite of environmental sensors that is in communication with an analysis module and with a database stored in a computer readable memory. The database may store information derived from the set of environmental sensors and from user input. User input is received via a user input module. The analysis module may infer the current environmental conditions of the user via the set of environmental sensors and classify a current user situation. The communication device may also include an emergency action module which is in communication with the analysis module and a plurality of operating features. The emergency action module may receive commands from the analysis module to assume control over a plurality of operating features based on a match between the inferred environmental conditions and the user situation. One of these features may be a transceiver in communication with a communication network.

Exemplary embodiments for a communication device control method consistent with this disclosure may include a suite of environmental sensors integral to the communication device that may periodically sample the user's environment. The user's environmental circumstances may be classified by an analysis module based on the output of the suite of environmental sensors. The derived set of environmental circumstances may then be compared to a set of templates to determine a matching template. An action script is then executed based at least partially on the matching template.

Further exemplary embodiments of this disclosure may include a computer readable medium upon which are recorded instructions to cause the communication device to periodically sample the user's environment at predetermined intervals utilizing a suite of environmental sensors integral to the communication device. The user's environmental circumstances may be classified by an analysis module based on the output of the suite of environmental sensors. The derived set of environmental circumstances may then be compared to a template to determine a matching template. The wireless communication device then executes an action script that is based at least partially on the matching template.

Other apparatuses, methods, and/or computer program products according to embodiments will be or become apparent to one with skill in the art upon review of the following drawings and Detailed Description. It is intended that all such additional systems, methods, and/or computer program products be included within this description, be within the scope of the present invention, and be protected by the accompanying claims.

DETAILED DESCRIPTION

Figure 1:
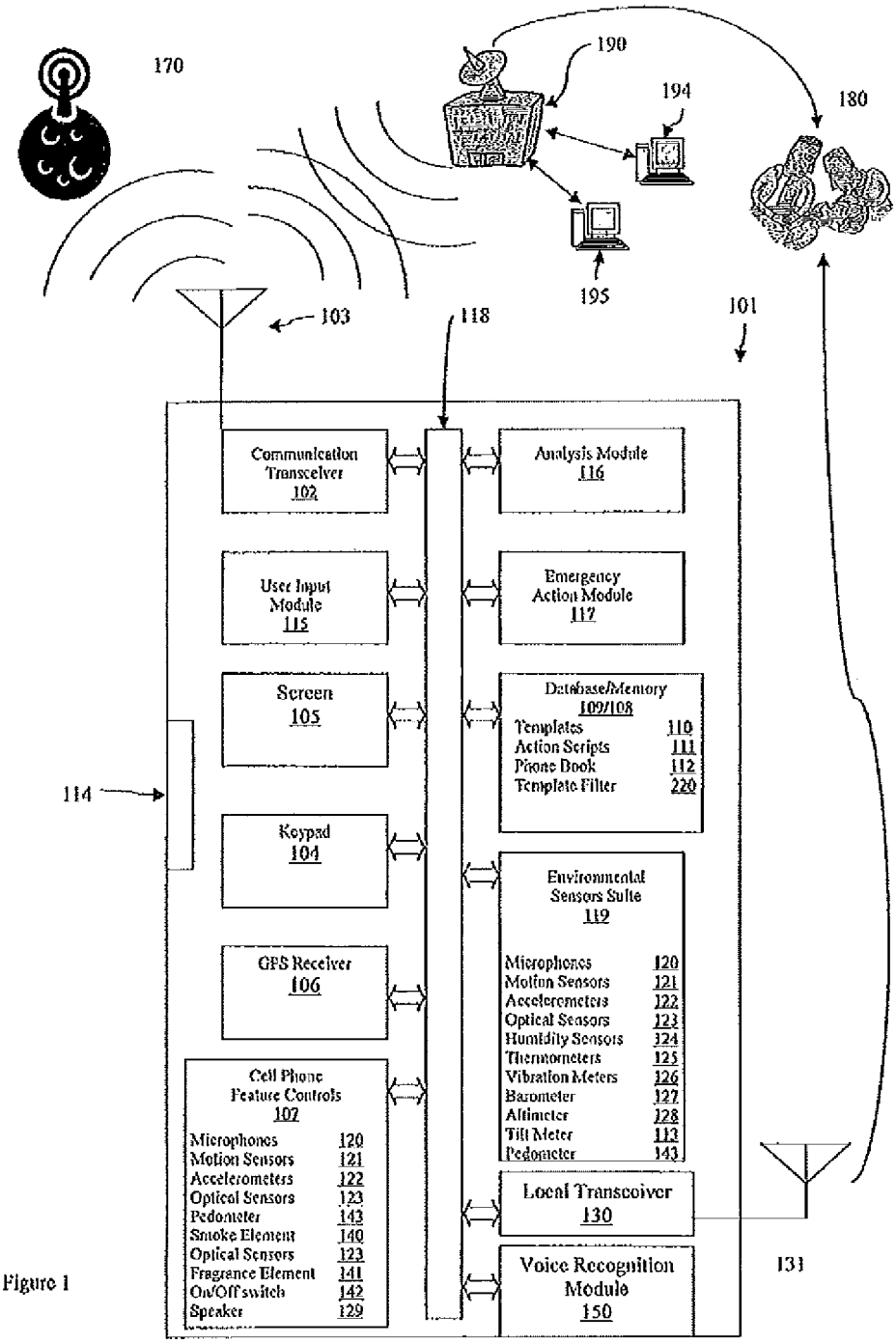
FIG. 1 is a block diagram illustrating functional components that may be found in a communications device with self actuating capability.

The following disclosure is directed to an apparatus and method for the self actuation of a wireless communication device ("WCD") allowing it to adjust to the user's environmental circumstances. A WCD may be any wireless communication device. Non-limiting examples may include a cell phone, a PDA, a pager, an MP3 player, a miniaturized computer and the like currently in existence or developed in the future. Further, a WCD may include any device which includes a wireless communications capability even when communications is not considered to be a main function of the device.

The use of WCDs has grown exponentially over the last decade. Today, most adults and a growing number of children carry a WCD of some type or another. The most common WCD is the ubiquitous cell phone, however, there are millions of devotes to pagers, personal digital assistants ("PDA"), Blackberrys® and other devices. Technologies are also merging. For example MP3 players may be incorporated into cell phones and vice versa. Users of WCDs depend upon them to keep them connected to business, family and friends in an increasingly hectic world.

WCDs have also inherited the public policy role of the plain old telephone system. Users still rely upon being able to dial "911" to summon assistance in an emergency such as a fire or a traffic accident. Governments, in turn, rely on public communications networks to receive timely notice of situations requiring the dispatch of a responding party in order to leverage scarce public safety resources.

However, situations arise from time-to-time where a user may find themselves in an environment where they are physically unable or are too preoccupied to make a call or execute a function that is inherently available in a WCD and that would otherwise be beneficial to execute. Sometimes a user may be able to take such action, but may for various reasons be precluded from taking such action in a timely manner. In these situations, it may be desirable to have a WCD that automatically detects the user's environmental circumstances, classifies them and then self actuates to take action based on the circumstances on behalf of the user. This may accomplish the beneficial actions that would otherwise not occur, or may accomplish such actions in a timelier manner, which may be a critical advantage in situations such as emergencies.

Such a circumstance may concern an abduction or an assault where a perpetrator may not allow a user time to manipulate their WCD. In such circumstances, the WCD may detect a series of abrupt accelerations and a scream or a codeword spoken by the victim. In such circumstances the WCD might enter a special mode where the WCD stops receiving calls, disables the on/off switch to avoid powering down, and calls police. The WCD may then allow the police to listen, take a picture, and/or obtain a GPS position while a police unit is dispatched.

In the following detailed description, references are made to the accompanying drawings that form a part hereof and which are shown, by way of illustration, using specific embodiments or examples. Referring now to the drawings, in which like numerals represent like elements through the several figures, aspects of the apparatus and methods provided herein will be described.

FIG. 1 is a block diagram illustrating functional components that may be found in a WCD 101. A WCD 101 may have one or more communication transceivers 102/130 and one or more corresponding antennas 103/131. One or more of the transceivers may be for long-range communications. One or more of the transceivers may be for short-range communications. A typical communications device 101 may also have a touch screen or keypad 104 to allow a user to input commands and data into the communications device 101. It may also have a screen display or other output device 105 with which to allow the user to view data and receive responses from the WCD 101. The WCD may incorporate a Global Positioning System ("GPS") receiver 106 or may be enabled to determine its position by triangulation.

A WCD 101 may also have incorporated within it a variety of operational modes or features 107 that allow a user to customize the WCD 101 to the user's preferences. Some of these features may be sensors of one type or another. The list of possible operating features and modes continues to grow over time and any specific examples mentioned herein are not intended to limit the potential features and modes that may be controlled by the disclosure herein. Non-limiting examples of operating features include speaker volume, speaker disable, ring tone disable, whisper tone caller ID, ring tone volume, type of ring tone, vibrate, type of vibration, screen intensity/brightness, screen disable or masking, LED indicator brightness, LED indicator disable, lighted keypad, camera, transfer call to voice mail, hands free, voice recognition, send/change auto e-mail response, release smoke 140, release fragrance 141 and disable the on/off switch or button 142 and/or another switch or button on keypad 104.

A WCD may also include a memory device 108 upon which may be recorded operating instructions and one or more databases 109. Such databases 109 may contain stored telephone numbers such as a phone book 112, templates 110, action scripts 111 and a set of template filtering rules 220. The memory device 108 is an example of computer readable media which store instructions that when performed implement various logical operations. Such computer readable media may include various storage media including electronic, magnetic, and optical storage. Computer readable media may also include communications media, such as wired and wireless connections used to transfer the instructions or send and receive other data messages.

WCD 101 may have at least one microphone 120 with which a user may engage in a verbal communication with another user, although there may be multiple microphones and/or audio sensors which sometimes may be termed other than "microphones." In addition to the user's voice, the microphone 120 can be used to monitor the user's sound environment and its various qualities.

Additional environmental sensors may also be included in WCD 101 individually or together in a sensor suite 119. A non-limiting set of illustrative examples of such environmental sensors may include motion sensors 121, optical sensors 123 (i.e. infrared, ultraviolet and/or a camera), vibration sensors 126, accelerometers and/or shock meters 122, humidity sensors 124, thermometers 125, barometers 127, altimeters 128, tilt meters 113 and pedometer 143. The sensor suite may include additional types of sensors as may satisfy a user's needs now or developed in the future. Although a list of additional sensors is voluminous, non-limiting examples of additional sensors may also include ion sensors such as nuclear radiation detectors, smoke detectors of various types, light spectrometers and audio frequency spectrum analyzers. Each sensor may be prompted or controlled by the AM 116 to periodically take samples of the device's then current environment or to take samples at predetermined times. Sample periodicity may vary between sensors in the sensor suite 119 such that both sampling frequency and number of samples taken at each sample time point may be different for different sensors. The frequency of sampling may be adjusted by the AM 116 in order to gain needed information. Multiple samples may be desired for some sensors so that a more accurate averaged reading can be calculated for each sample point.

Further, augmenting environmental and positional data may be received from a central location 190 that may include a weather server 194. Non-limiting examples of central locations may include a communication system's central office, a wireless network communications tower, a mobile telephone switching office (MTSO) or a substation. Non-limiting examples of augmenting data that may be sampled at the central location 190 and transmitted to the AM 116 in the communication device 101 may include temperature, smog condition, cloud cover and relative humidity. Sample readings that may be applicable to a wide area or may require cumbersome sensor devices may be facilitated in this manner. Similarly, the central office 190 may be aware of an emergency in a particular area and can provide parameters related to such an emergency that may be used to determine a user's circumstances (e.g., a tornado warning or a fire). Further, a central office 190 may be in communication with a Geographical Information System ("GIS") 195 that may be able to provide detailed cartography and aerial photography information.

WCD 101 may comprise a User Input Module ("UIM") 115 whereby user input utilizing the keypad 104 may be parsed and then used to populate and/or modify the database 109. Through the UIM 115, the user may create, delete or modify user preferences and templates 110 stored in memory 108. User preferences can be utilized to create templates which are then compared with the WDC's 101 current environmental circumstances. A generic set of templates may be initially included by the manufacturer of WDC 101 and then modified by the user. The UIM 115 may also be accessed through a computer interface connection 114 (i.e. a physical cable port) or may be accessed by a user web page whereby the user inputs his preferences via an internet communication with a central office 190. The central office 190 may then download the information to the WCD 101. UIM 115 may also be used to directly summon assistance from a responding party by a user (i.e. pushing a panic button). Further, UIM 115 may be used to accept various inputs from the user that, in combination with the user's environmental circumstances sampled by sensor suite 119, may summon assistance.

WCD 101 may include an Analysis Module ("AM") 116. An AM 116 may comprise a single module or several sub-modules working in unison. A "module" may comprise software objects, firmware, hardware or a combination thereof. The AM 116 may control the timing and duration of an environmental sampling. A sample may be an instantaneous/spot sample or the sample may extend over an extended period of time as may be required by the type of sensor and/or sensor technology and/or the analysis that is to be performed by the AM 116. The environmental samples utilized by the AM 116 in determining a user's circumstances may be a single sample from a single sensor, sequential samples taken from a single sensor or coordinated samples of any desired duration taken from multiple sensors. Samples can also be taken continually and/or periodically. Where sensor periodicities between sensors vary, the AM 116 may designate that one or more sensor readings remain valid until designated otherwise. AM 116 may coordinate the sampling periodicity to optimize sensor suite performance. Further, the AM 116 may direct one or more sensors in sensor suite 119 to take immediate, ad hoc readings or a series of rapid readings. Sample times and periodicity may also be controlled by the user as a user preference.

Sample and signal processing techniques are well known and references to such are widespread and ubiquitous in the art. Non-limiting examples of calculated quantities that may be obtained from environmental samples and that may be potentially relevant to a determination of current circumstances may include peak-to-average ratios, variation, frequency of surpassing a threshold, filtering of various types including digital filtering, spectral shape analysis via Fourier transforms of time-samples (e.g. Fast Fourier Transforms), use of other types of mathematical transforms, spectral shape variation, variation rate and frequency spectrum analysis (e.g. audio, vibration and/or optical). It may also be useful to sample, compare or analyze different color CCD pixels sensed by a camera 123.

Further, each measured audio, motion and optical circumstance sample may be separated into sub-bands of the sensor's range, be it frequency or other type of range, by passing signals from sensor suite 109 through stacked band-pass filters and/or other various filter configurations. Derived aspects may be determined via well know digital signal processing methods in addition to or instead of analog filtering and ratio detection techniques. The analysis techniques discusses herein are non-limiting examples of techniques that may be used within an AM 116. Other techniques that may be known to the art may be desirable to determine certain aspects.

As non-limiting, illustrative examples of analysis, the AM 116 may directly determine the peak and average intensity levels concerning the user's audio and/or optical environment utilizing audio sensors and optical sensors 123 such as the microphone 120 and a camera, respectively. AM 116 may determine facts about the user's current circumstances by sampling peak and average translational amplitude (i.e., speed), peak and average spin amplitude, and peak and average vibration. Such measurements may be conducted with inputs from a GPS receiver 106, accelerometers and/or shock meters 122, tilt meters 113 and vibration meters 126. Although the GPS receiver 106 can calculate speed when operating under good conditions and strong satellite signals, intermittent reception can hinder GPS speed measurements. Therefore, it may be useful to combine a plurality of sensor inputs (i.e., GPS and triangulation) to determine a parameter such as speed in order to better ensure a satisfactory level of accuracy when one or more sensors is impaired or ineffective for any reason. Further, AM 116 may utilize indicators of a user's current or past activity such as whether there is a call in progress, whether there is menu access/manipulation, searching a contact list, dialing, repeated attempts to dial and the status of a battery charge. Note that frantic manipulation of device controls may indicate a user is in extremis.

AM 116 may operate in conjunction with a voice recognition module ("VRM") 150. VRM 150 may distinguish the user's voice from that of a perpetrator/attacker or unauthorized user. The recognition of a voice pattern may be used as an input to trigger a template 110. The VRM 150 may also be used to terminate an action script 111 already being executed. The nature of the VRM 150 may be any combination of available software, firmware or hardware that would accommodate the requirements of a designer or manufacturer.

Inputs to the AM 116 may include recent call history. Call history may include voice communications and email/instant/text messaging inputs such as who was called, who called, when calls are placed or received and with what frequency and the length of calls. Any type of communication history may be utilized as an input. Additional types of call history data may also prove useful and be included if desired.

AM 116 may assemble the measured and derived aspects of the user's circumstances and compare the assembled aspects to one or more templates 110 stored in memory 108. Memory 108 may be integral to the communication device 101 or resident in another device in communication with WCD 101. As AM 116 accesses and compares the stored templates 110, the AM may proceed to eliminate those templates matching dissimilar environmental circumstances by utilizing a set of template filtering rules 220 (See FIG. 2). As a non-limiting example, a template filtering rule may include a "look first rule" where a defined subset of the templates 110 is examined first. This subset may comprise templates 110 that are of most concern or deal with potentially serious situations. This subset may be augmented to include those templates that have been matched with certainty or those that have one or more salient environmental circumstances (e.g. the time of day or an extremely high ambient temperature).

Other filtering rules may select a template 110 if only if a subset of the required set of environmental circumstances is present. In such a situation, the danger may be considered uncertain (e.g. any 6 of 10 environmental circumstances have been matched). Such matches with "uncertainty" may indicate a possible or developing danger. As such the user may be required to enter a safety code periodically to prevent an escalating report to a responding party. Alternatively, filtering rules may select a template 110 by discerning that the subset of required environmental circumstances occurs in a particular order or within a particular time window. A particular order or occurrence within a particular time window may also be used as a preliminary screen in order that the template be more closely matched to the environmental circumstances.

WCD 101 may also comprise an Emergency Action Module ("EAM") 117. Should the AM 116 determine that a situation exists by matching the user's environmental circumstances to a template 110, EAM 117 may take operational control of the WCD 101. Such control by the EAM 117 may manifest itself by the EAM 117 initiating one or more action scripts 111 in series, in parallel or a combination of both. EAM 117 may comprise a single module or several sub-modules working in unison. A module may comprise software objects, firmware, hardware or a combination thereof.

Actions Scripts 111 may be a set of pre-determined procedures or subroutines to be executed by the WCD 101. Such Action Scripts 111 may effectively convert the WCD 101 from a WCD to a wireless tracking device and/or eavesdropping device. An Action Script 111 may allow EAM 117 to control the plurality of features 107 resident in a WCD 101 as well as the transceivers 102/130, screen 105, keypad 104, GPS receiver 106 and other WCD components. The EAM 117 may prevent the user from adjusting features individually via keypad 104 and/or by the UIM 115. As a non-limiting example, the EAM 117 may disable the on/off switch of the WCD 101 so as to prevent someone from turning off the WCD.

EAM 117 may also grant full or partial remote control of any of the features and components of WCD 101 to a remote user that may be a responding party 180. A responding party 180 may be anyone that can render assistance, directly or indirectly. Non-limiting examples of a responding party may include the police, the fire department, the gas company, the Department of Homeland Security, private guards, the parents or guardians of children, a nurse, wireless service provider, a doctor or a security service. The list of potential responding parties is voluminous. Non-limiting examples of scenarios where it would be useful for a responding party to have remote control of features of the WCD 101 may be a child abduction or a house fire. The subject matter, herein, may be used in a myriad of circumstances and any examples discussed are merely exemplary.

An action script 111 may be terminated by user action. Such user action may be the simple input of a series of key strokes. In other cases, a photograph of the user or a photograph of the user's immediate surroundings may be required by the action script 111 or may be required by the responding party 180 in order to terminate. Any user action via WCD 101 may be found useful in this manner.

In the exemplary, non-limiting scenario of a child abduction, the WCD 101 may be a miniaturized WCD 101 that can be concealed in or among the child's clothing or it may be a cell phone overtly carried by the child. The WCD 101 does not have to have the appearance of a typical hand held WCD 101. An abduction template 110 and a corresponding action script 111 may be created by a user, the child's parents or, alternatively, a third party such as the police department. The abduction template may look for a particular set of sensor inputs from sensor suite 119. Those sensor inputs may include, for example, a rate of speed such as would be characteristic of a vehicle or a noteworthy acceleration or series of accelerations as one my expect in a struggle. There may be one or more preset times at which the child is expected to verbally call in or to arrive at a particular location. Further non-limiting examples may include a verbal code word that the child may utter, where in most cases this code word will be a secret word that will be non-obvious to an observer. Furthermore, a geographic range limit may be created where straying beyond the geographic boundary may trigger the action script 111. The absence of an expected sensor input may also be a useful input (i.e. the lack of movement). The combination and permutations of physical circumstances and alarm settings is practically inexhaustible and may include the non-occurrence of certain events. Sequence or order of these may also be used in triggering templates, for example a template may be triggered only when an absence of movement is preceded by an acceleration exceeding a particular threshold.

Should the environmental circumstances constituting an "abduction" template be satisfied, the EAM 117 may assume control over the features of the WCD 101 and may execute the "abduction" action script 111. Assuming control may necessitate disabling or overriding other instructions utilized during normal operation of WCD 101. A non-limiting exemplary action script may execute one or any of the following: 1) disable the WCD on/off switch 142; 2) dial a responding party's phone number (i.e. the police); 3) broadcast the WCD 101 GPS location (or, alternatively cause WCD 101 to triangulate its position); 4) broadcast an alert via local transceiver 130 to nearby wireless communication devices; and 5) take a photograph. Other non-limiting examples of action incorporated into an action script 111 may include a broadcast of an alert and/or photograph to multiple communications devices on a network that have been identified by the central office 190 as being in or approaching the area.

Alternatively, instead of the WCD 101 placing a call to the responding party 180, the WCD may be scripted to automatically answer a call from the responding party without vibrating or emitting a ring tone, thereby allowing the responding party to listen surreptitiously and/or to allow additional responding parties to join the surreptitious listening. The responding party 180 may also be offered a menu or prompt by WCD 101 allowing the responding party to request data from WCD 101 or operate one or more of WCD features 107 remotely. As a non-limiting example, such data may be a GPS location, a video or a direction of travel. Features to be controlled, for example, may include releasing smoke from a smoke element 140 within the WCD 101, disabling the on/off switch 142 or holding open a voice channel that could otherwise be closed.

In another non-limiting example, the WCD 101 may include a fire emergency template 110. Fire emergency template 110 and a corresponding action script 111 may be created by the user, the building's owner or, alternatively, the fire department or other third party. The fire emergency template may be looking for a particular set of sensor inputs from sensor suite 119. Those sensor inputs may be the presence of smoke, fire light or an excessive temperature as would be expected in a fire. There may be a verbal code word that a user of the WCD 101 may utter. Alternatively, the central office 190 of the wireless service provider may learn of a fire at a location and send a notice to all WCDs that are reporting GPS readings at the location. The notice may satisfy a "fire" template in all of those WCDs. The combinations and permutations of physical circumstances and action script requirements are practically inexhaustible.

Should the "fire" template be satisfied, the EAM 117 may assume control over the features of the WCD 101 and may execute a "fire" action script 111. A non-limiting example of an action script may execute one or any of the following mode changes: 1) disable the WCD on/off switch 142; 2) dial a responding party's phone number, the responding party may be the fire department; 3) broadcast the WCD 101 GPS location (Alternatively cause WCD 101 to triangulate its position); and 4) turn on microphone 120 to allow the responding party to listen.

Communication between each of the AM 116, EAM 117, memory 108, sensor suite 109, UIM 115, Transceiver 102, GPS Receiver 107 and other elements within the WCD 101 may be facilitated by Bus 118. Bus 118 may be comprised of one or a plurality of busses as is desired.

Further embodiments consistent with the disclosure herein may comprise a WCD 101 that may work in conjunction with a secondary communication device 170 ("SCD"). SCD 170 may have a limited capability relative to WCD 111. For example, SCD 170 may only dial a responding party 180 when separated by more that a specified distance from WCD 111. Until separation, SCD 170 electronically senses WCD 111 from time to time via one of antennas 103/131 and therefore exists in a low power state. Upon separation, SCD 170 may awaken and contact the responding party. In the alternative, the SCD 170 may provide an input to a template 110 in WCD 101 upon awakening thereby triggering a template in WCD 101.

Figure 2:
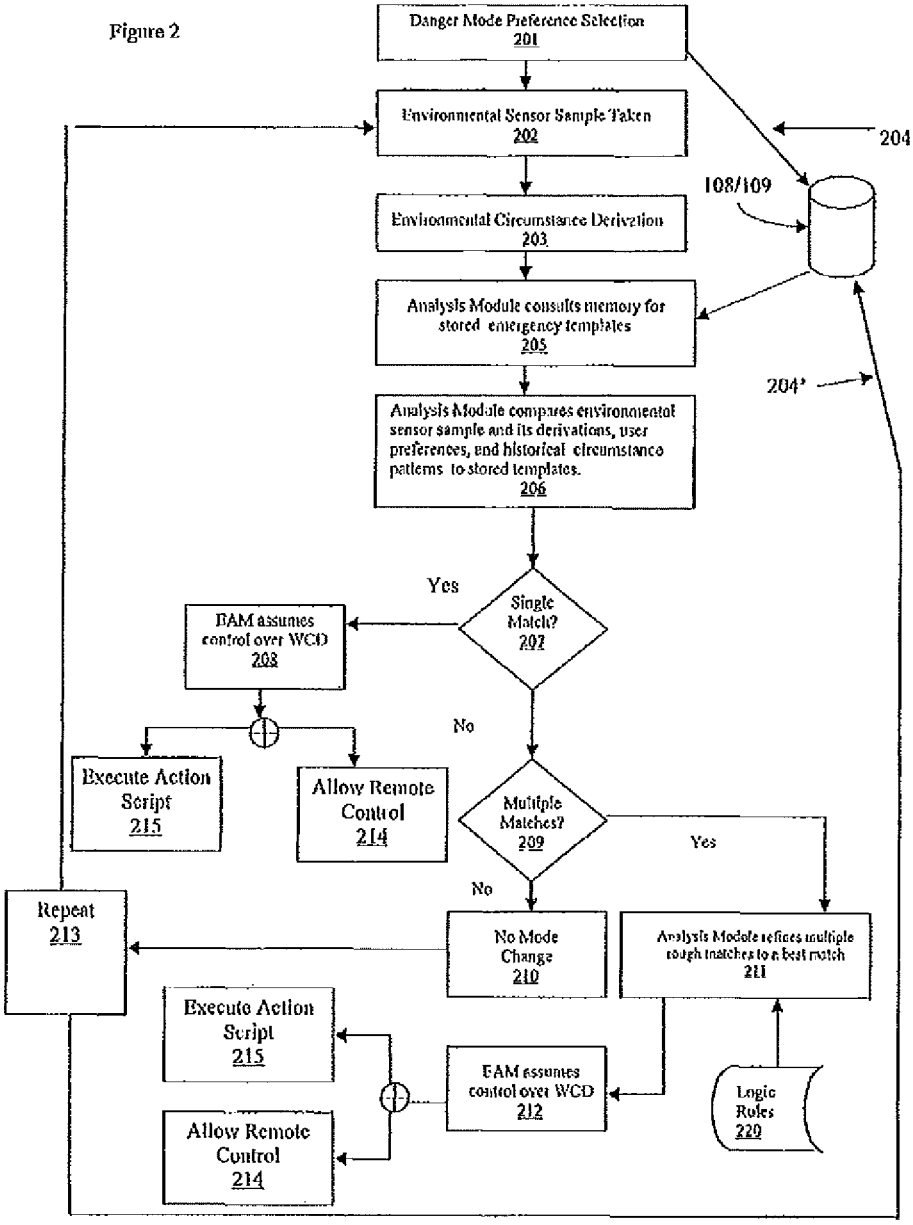
FIG. 2 is a flow chart illustrating an example of a method implementing a self actuation capability.

FIG. 2 provides an exemplary method for implementing control of a WCD 101. The steps and process presented are exemplary. Additional steps may be added, steps broken down to component sub-steps and their order may be modified without diverting from the disclosure herein.

At process 201, a set of templates is created or amended. A generic set of templates may be initially included by the manufacturer of WCD 101 and then modified by the user. Templates may be created utilizing UIM 115 and keypad 104. A user may also create templates 110 via an Internet or other network web page associated with the central office 190 of the service provider for the WCD 101. At process 204, modified or new templates may be stored in memory 108.

At process 202, the sensor suite 119 takes samples of the user's environmental circumstances using exemplary sensors 120-129 and 113-114. A sample may be taken by all of the sensors in the sensor suite 119 or any subset thereof. Samples may be taken on a predefined schedule, a periodic basis, on a command triggered by the AM 116 or a random/ad hoc basis. Samples may be spot samples, time samples, multiple sequential samples, continuous measurements or any combination thereof The timing of samples maybe controlled by a chronometer internal to the WCD 101 (not shown) or by one or more re-settable timers (not shown). Sample timing may also be controlled by the central office 190. The sampling processes within sensor suite 119 may conform themselves to a sampling periodicity defined by the user of WCD 101 or central office 190. The nature, timing and methods for taking a given set of samples is dependent upon the user's requirements and can vary widely to conform to the purposes desired. Examples of sampling techniques are discussed herein are exemplary and are not intended to limit the scope of the disclosure herein.

The sample results are processed and the user's environmental circumstances are derived at process 203. The derivation of the user's circumstances may also include accessing additional data from a remote location such as the central office 190. Sensor measurements can be processed and combined in any manner that is required. Non-limiting examples of processed sensor measurements include peak amplitudes of the sensed aspect may be determined. In addition, average amplitudes, peak-to-average amplitude ratios, rates of change and frequency of events exceeding a threshold may be calculated. A frequency spectrum analysis may be useful as well as conducting spectral shape analysis resulting from Fourier Transform of time-samples. An optical analysis may be conducted by processing color and intensity of different color pixels or sets of pixels from a camera sensor 123. Similarly, the user's motion can be analyzed as well as any vibration. Input from a pedometer 143 or from the GPS 106 may be other non-limiting examples of motion data input. Further, each audio, motion and optical aspect may additionally be determined and analyzed in separate sub-bands of the sensor's detection range. Other analog and digital signal processing techniques that may also be employed are well known. Signal processing techniques may be applied to the particular data of concern described herein to render results that can be used to make decisions regarding the environmental circumstances and the choice of the proper template.

Figure 3:
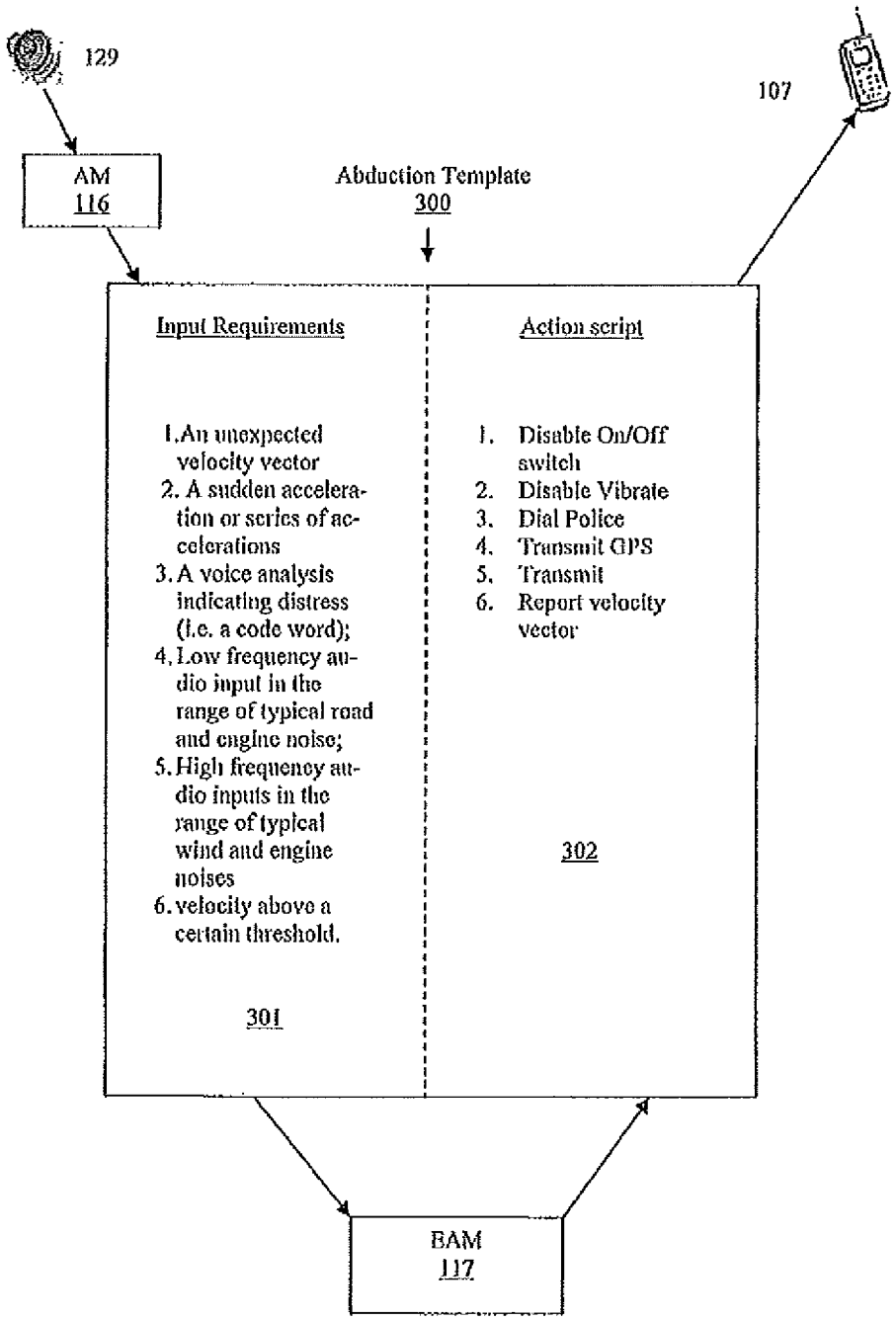
FIG. 3 is an illustration depicting the functionality of an exemplary template within a communication device.

In process 205, the AM 116 consults memory/database 108/109 for user preferences and stored templates 110. FIG. 3 is an abstract depiction of a template 300. The exemplary, non-limiting "Abduction" template may be just one of a myriad of possible templates that may be created. Template 300 may comprise sets of WCD 101 default settings, user preferences, learned responses or combinations thereof describing an integrated triggering set of user circumstances for the WCD. Each template 110 reflects a composite model of a physical situation in which the user may be involved.

Templates 110 may be organized into groups or categories. A particular template 300 may be associated with a certain combination of circumstances including measured or derived sensor measurements, current user activity events and historical user activity as inputs requirements 301. The selection of an appropriate template may be facilitated by applying filtering logic rules 220 to choose templates that may apply to the user's immediate circumstances. The filtering logic rules 220 may be stored in the memory/database 108/109, a remote device or at a central office 190. The logic filtering rules 220 may comprise software objects, firmware, hardware or a combination thereof.

Upon the receipt of the sensor inputs and user activity, the AM 116 compares the sensor 119 inputs and user activity to the input requirements 301 of the selected templates in process 206. As a non-limiting example, the input requirements 301 that may correspond to the "Abduction" template may include: 1) an unexpected velocity vector indicating transportation in a vehicle; 2) a sudden acceleration or series of accelerations; 3) a voice analysis indicating distress (i.e. a code word); 4) low frequency audio input in the range of typical road and engine noise; 5) high frequency audio inputs in the range of typical wind and engine noises; and 6) velocity above a certain threshold. Certain orders or sequences of these sensor input requirements 301 may also be included as additional inputs that may be matched. Thresholds/set points for sensor input requirements 301 may be preprogrammed by the manufacturer or a responding party. They can also be set by the user or "learned" by the WCD 101 by incorporating "learn mode" software which may applied to these various embodiments to automate the programming and readjustment of the thresholds and set points. A user "override" of a template can be a particularly useful learning input. A user "override" of a template, especially when overriding is repeated and or frequent, can also be used as a form of "dead man's switch" where the user must cause an action to occur from time to time to prevent a template from being triggered. Non-limiting examples of such actions may include inputting a series of key strokes periodically, speaking periodically, speaking one of a set of code words periodically, calling a phone number prior to a time certain, and holding down a button.

If the comparison at process 206 results in a match to a single template 300 at decision point 207, the AM 116 may relinquish control of the cell phone features 107 and other WCD 101 components to the control of the EAM 117 at process 208. This change may be a permanent change or a temporary change that reverts to a set of default settings or to the previous settings after a specified time delay. If temporary, a subsequent sample may refresh the template 300 for another period of time. If the change was permanent, a subsequent sample of the user's circumstances may either maintain the then current template 300 or dictate a change to another. Alternatively, an external input such as from an emergency responder or the WCD service provider 190 may be necessary to deactivate the triggered template.

If the comparison of process 206 returns multiple matching templates at 209, the AM 116 may refine the comparison utilizing one or more filtering logic rules 220 in order to select the "Best Match" template at process 211. The filtering logic rules 220 may be stored in memory 108, a remote location or at the communication device's central office 190. Should the comparison process 206 produce multiple, equally likely templates, AM 116 may resolve the choice using a more detailed but more demanding and/or time consuming analysis. Non-limiting example of such additional analysis may include a "random pick", a "best guess" or a "default to pre-selected template" analysis. Additional non-limiting examples of filtering logic rules 220 may include selecting the template that matches the most environmental circumstances, weighting the environmental circumstance measurements and selecting the template with the best match to those weighted items and/or weighting certain combinations of measurements and subsequently selecting the template with the best "weighted" match. Upon arriving at a best match, EAM 117 assumes control over the features and other components of the WCD 101 at process 212.

If the comparison in process 206 returns no match at all, then there may be no mode change at process 210. The sampling process may be reset and repeated, at process 213. Any change to the operating mode of the WCD 101 may be recorded in database 109 at process 204'. Database 109 may reside in memory 108, Database 109 may also reside in a remote location or at the communication device central office 190. The data base 109 may also be distributed amongst several memory devices in different locations.

Upon arriving at a template match at either process 207/211, the EAM 117 and its resident instructions may execute one of more action scripts 111 at process 215. Action Scripts 111 may comprise a set of one or more instructions and subroutines that cause the WCD 101 to execute or enable certain functions to produce a desired functionality internal and external to the WCD 101. In addition or in the alternative, the EAM 117 may grant a responding party 180 remote control over one or more features of WCD 101 at process 214.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

The invention claimed is:

1. A method, comprising:

receiving, by a computer interface connection, a set of environmental data from a central telecommunications server;

deriving, by an analysis module, a set of environmental circumstances based on the set of environmental data and output from different types of environmental sensors, integrated into a communication device, that periodically sample a user environment, wherein the different types of environmental sensors have different respective sampling periods;

comparing, by the analysis module, the set of environmental circumstances to a set of templates to determine whether there is a matching template;

selecting, if more than one of the templates matches the set of environmental circumstances, a best-match template; and executing, if the best-match template is selected, an action script.

2. The method of claim 1, wherein the best-match template is determined by applying a set of logic rules to the set of templates.

3. The method of claim 1, further comprising sending a command from the analysis module to an emergency action module to assume control of a component of the communication device in response to selection of the best-match template.

4. The method of claim 1, further comprising relinquishing control of a component of the communication device to an emergency responding party in response to selection of the best-match template.

5. The method of claim 4, wherein the component for which control is relinquished to the emergency responding party belongs to a group of components comprising a camera, a microphone, a transceiver, an alternative transceiver, a speaker, an on/off switch, a smoke element, a global positioning response repeater, a user interface display, and a keypad.

6. The method of claim 1, wherein the set of environmental circumstances includes a non-occurrence of an expected event.

7. The method of claim 1, wherein the set of environmental data comprises data received from a weather server.

8. A non-transitory computer readable storage device having instructions recorded thereon which, when executed by a processor, cause the processor to perform operations comprising:

receiving a set of environmental data from a central telecommunications server;

deriving a set of environmental circumstances based the set of environmental data and on output from different types of environmental sensors, integrated into a communication device, that periodically sample a user environment, wherein the different types of environmental sensors have different respective sampling periods;

comparing the set of environmental circumstances to a set of templates to determine if there is a matching template;

selecting, if more than one of the templates matches the set of environmental circumstances, a best-match template; and executing, if the best-match template is selected, an action script.

9. The non-transitory computer readable storage device of claim 8, wherein the instructions, when executed by the processor, further cause the processor to determine the best-match template by applying a set of logic rules to the set of templates.

10. The non-transitory computer readable storage device of claim 8, wherein the instructions, when executed by the processor, further cause the processor to send a command to an emergency action module to assume control of a component of the communication device in response to selection of the best-match template.

11. The non-transitory computer readable storage device of claim 8, wherein the instructions, when executed by the processor, further cause the processor to relinquish control of a component of the communication device to an emergency responding party in response to selection of the best-match template.

12. The non-transitory computer readable storage device of claim 11, wherein the component to which control is relinquished to the emergency responding party belongs to a group of components comprising a camera, a microphone, a transceiver, an alternative transceiver, a speaker, an on/off switch, a smoke element, a global positioning repeater, a user interface display, and a keypad.

13. The non-transitory computer readable storage device of claim 8, wherein the set of environmental circumstances includes a non-occurrence of an expected event.

14. The non-transitory computer readable storage device of claim 8, wherein the set of environmental data comprises data received from a weather server.

15. A device, comprising:

a processor; and a memory storing instructions which, when executed by the processor, cause the processor to perform operations comprising:

receiving a set of environmental data from a central telecommunications server;

deriving a set of environmental circumstances based the set of environmental data and on output from different types of environmental sensors, integrated into a communication device, that periodically sample a user environment, wherein the different types of environmental sensors have different respective sampling periods;

comparing the set of environmental circumstances to a set of templates to determine if there is a matching template;

selecting, if more than one of the templates matches the set of environmental circumstances, a best-match template; and executing, if the best-match template is selected, an action script.

16. The device of claim 15, wherein the instructions, when executed by the processor, further cause the processor to determine the best-match template by applying a set of logic rules to the set of templates.

17. The device of claim 15, wherein the instructions, when executed by the processor, further cause the processor to send a command to an emergency action module to assume control of a component of the communication device in response to selection of the best-match template.

18. The device of claim 15, wherein the instructions, when executed by the processor, further cause the processor to relinquish control of a component of the communication device to an emergency responding party in response to selection of the best-match template.

19. The device of claim 15, wherein the set of environmental circumstances includes a non-occurrence of an expected event.

20. The device of claim 15, wherein the set of environmental data comprises data received from a weather server.

* * * * *